US011793693B2

(12) United States Patent
Takado et al.

(10) Patent No.: US 11,793,693 B2
(45) Date of Patent: Oct. 24, 2023

(54) STEERING MECHANISM AND WHEELCHAIR EQUIPPED WITH SAME

(71) Applicant: HONDA MOTOR CO., LTD., Tokyo (JP)

(72) Inventors: Junji Takado, Saitama (JP); Hiroshi Gomi, Saitama (JP); Yasushi Yoneda, Kanagawa (JP)

(73) Assignee: Honda Motor Co., Ltd., Tokyo (JP)

( * ) Notice: Subject to any disclaimer, the term of this patent is extended or adjusted under 35 U.S.C. 154(b) by 657 days.

(21) Appl. No.: 17/045,057

(22) PCT Filed: Dec. 28, 2018

(86) PCT No.: PCT/JP2018/048576
§ 371 (c)(1),
(2) Date: Oct. 2, 2020

(87) PCT Pub. No.: WO2020/003562
PCT Pub. Date: Jan. 2, 2020

(65) Prior Publication Data

US 2021/0161739 A1 Jun. 3, 2021

(30) Foreign Application Priority Data

Jun. 27, 2018 (JP) ..... 2018-121582

(51) Int. Cl.
*A61G 5/02* (2006.01)
*A61G 5/10* (2006.01)

(52) U.S. Cl.
CPC ..... *A61G 5/026* (2013.01); *A61G 5/1051* (2016.11)

(58) Field of Classification Search
CPC ..... A61G 5/026; A61G 5/1051
See application file for complete search history.

(56) References Cited

U.S. PATENT DOCUMENTS 4,720,117 A * 1/1988 Hay ..... A61G 5/023 280/250
5,324,060 A * 6/1994 Van Vooren ..... A61G 5/026 297/DIG. 4

(Continued)

FOREIGN PATENT DOCUMENTS

JP 2002-035042 A 2/2002
JP 2004-510498 A 4/2004

(Continued)

*Primary Examiner* — Kevin Hurley
*Assistant Examiner* — Michael R Stabley
(74) *Attorney, Agent, or Firm* — Carrier, Shende & Associates P.C.; Joseph P. Carrier; Fulchand P. Shende

(57) ABSTRACT

Provided is a steering mechanism (8) including a swing bar (81*a*) which swings in response to input from a rider, a cam guide (83*c*) slidable on a peripheral surface of a column section (5*a*), a ball joint (82*a*) which slides the cam guide (83*c*) in response to the swinging of the swing bar (81*a*), a cam follower (83*b*) vertically provided on the peripheral surface of the column section (5*a*) to rotate the column section (5*a*) in response to the sliding of the cam guide (83*c*), and a coil spring (83*e*) which returns the cam guide (83*c*) to a predetermined rotation angle. The cam follower (83*b*) comes in contact with a cam surface (83*c*4) of the cam guide (83*c*) which has a recess surface shape, at two positions on the peripheral surface, in a state where the column section (5*a*) is located at a predetermined position.

8 Claims, 9 Drawing Sheets

(56) References Cited

U.S. PATENT DOCUMENTS

| | | | | |
|---|---|---|---|---|
| 5,501,480 | A * | 3/1996 | Ordelman | A61G 5/026 280/250 |
| 5,518,081 | A * | 5/1996 | Thibodeau | B60N 2/38 180/907 |
| 7,293,623 | B2 | 11/2007 | Berkelmans | |

FOREIGN PATENT DOCUMENTS

| | | | |
|---|---|---|---|
| JP | 2005-143743 | A | 6/2005 |
| JP | 2012-000394 | A | 1/2012 |
| JP | 2014-180419 | A | 9/2014 |

* cited by examiner

STEERING MECHANISM AND WHEELCHAIR EQUIPPED WITH SAME

TECHNICAL FIELD

The present invention relates to a steering mechanism for use in a wheelchair, particularly a racing wheelchair for use in a track race, a marathon or the like, and a wheelchair equipped with the steering mechanism.

BACKGROUND ART

Heretofore, there has been a racing wheelchair for use in a track race, a marathon or the like, comprising a cage where a rider sits down, a pair of rear wheels attached to right and left sides of the cage, a vehicle body frame extended in front of the cage, a front fork rotatably attached to the vehicle body frame, and a front wheel (a steering wheel) held by the front fork.

In this type of wheelchair, as a mechanism which rotates the front fork to set a steering angle of the front wheel, a mechanism comprising not only a handle coupled to the front fork but also a steering mechanism called a track lever is known (e.g., see Patent Literature 1).

The steering mechanism of Patent Literature 1 comprises a swing bar which swings right and left relative to the vehicle body frame, a link mechanism to transmit the swinging of the swing bar to the front wheel, and a maintenance mechanism to maintain the steering angle of the front wheel.

According to this steering mechanism, the rider presses the track lever provided at a rear end of the swing bar so as to lightly tap the lever from either the left or right. Consequently, the steering angle of the front wheel can be changed via the swing bar and the link mechanism, and the steering angle can be maintained at a predetermined angle by the maintenance mechanism. Therefore, in general, this steering mechanism is for use, for example, in running around a corner in a track race or the like.

CITATION LIST

Patent Literature

Patent Literature 1: Japanese Patent Laid-Open No. 2012-000394

SUMMARY OF INVENTION

Technical Problem

In the steering mechanism described in Patent Literature 1, a swing bar is built in a vehicle body frame. However, a part of a link mechanism (specifically, including a damper link, a coupling arm which couples the damper link and the swing bar, and a vice handle which couples the damper link and a front fork) is disposed in a state of protruding to a side of the vehicle body frame.

Consequently, there is concern that the part which is not housed in the vehicle body frame of the steering mechanism generates air resistance. Furthermore, there is concern that the part is conspicuous and spoils aesthetics.

The present invention has been developed in view of respects described above, and an object thereof is to provide a steering mechanism of a structure which is easy to house in a vehicle body frame, and a wheelchair equipped with the mechanism.

Solution to Problem

A steering mechanism of the present invention is a steering mechanism of a wheelchair comprising a cage where a rider sits down, a vehicle body frame extended in front of the cage, a holding member rotatably attached to the vehicle body frame, and a steering wheel held by the holding member, the holding member having a rod-like pole section rotatably supported by the vehicle body frame to rotate integrally with the steering wheel, the steering mechanism comprising:

- a swing bar which swings in response to input from the rider,
- a sliding section having an abutment surface and being slidable at least in a peripheral direction on a peripheral surface of the pole section,
- a first link section which couples the swing bar and the sliding section to slide the sliding section in response to the swinging of the swing bar,
- a second link section which is vertically provided on the peripheral surface of the pole section to protrude from the peripheral surface, and which abuts on the abutment surface to rotate the pole section in response to the sliding of the sliding section, and
- an urging section which urges the sliding section to rotate and return the pole section to a predetermined rotation angle via the sliding section and the second link section,
- wherein the abutment surface is a recess surface dented in a direction along a rotation axis of the pole section,
- the second link section is located at a bottom of the abutment surface in a state where the pole section is at the predetermined rotation angle, and
- the second link section comes in contact with the abutment surface at two positions on the peripheral surface of the second link section, when the second link section is located at the bottom of the abutment surface.

In the steering mechanism of the present invention including such a configuration, to set the steering angle of the steering wheel via the steering mechanism, first, force input by the rider is transmitted to the sliding section via the swing bar and the first link section. Afterward, the sliding section rotates, via the second link section, the pole section in which the second link section is provided, to set the rotation angle of the pole section (i.e., the steering angle of the steering wheel).

Here, the second link section is provided on the peripheral surface of the pole section. Furthermore, the sliding section is configured to slide on the peripheral surface of the pole section. That is, in this steering mechanism, a part of the mechanism to set the steering angle of the steering wheel is located in a vicinity of the peripheral surface of the pole section, or configured to operate in the vicinity of the peripheral surface.

Consequently, in this steering mechanism, the part of the mechanism to set the steering angle of the steering wheel is easy to house in a part of the vehicle body frame which is also used in a conventional wheelchair (specifically, for example, a cover section provided at a front end of the vehicle body frame to cover the pole section, or the like).

Therefore, in the steering mechanism of the present invention, as compared with a conventional steering mechanism, the part of the mechanism can be easily housed in the vehicle body frame. Therefore, when the mechanism is mounted in the wheelchair, aerodynamic performance degradation and aesthetic deterioration due to the steering mechanism can be suppressed.

Additionally, in general, a steering mechanism for a racing wheelchair comprises an urging section which returns the steering angle of the steering wheel (i.e., the rotation angle of the pole section of the holding member which holds the steering wheel) to a predetermined angle.

However, in a case where an urging force of the urging section is too strong and when the rider performs an operation to set the steering angle, a large frictional force is generated between members which form the steering mechanism. There is concern that due to the frictional force, resistance is generated, and rattling is generated. Such resistance and rattling are especially easily generated, when the operation is started (i.e., when the pole section is rotated from a predetermined angle).

To solve the problem, in this steering mechanism, the abutment surface of the sliding section is formed in the recess surface shape. Furthermore, in a state where the urging section brings the pole section at the predetermined rotation angle, the second link section is located at the bottom of the abutment surface, and the second link section comes in contact with the abutment surface at two positions on the peripheral surface of the second link section.

Consequently, in this steering mechanism, a part where the sliding section comes in contact with the second link section is reduced, and the frictional force generated between the sections is decreased to suppress the resistance and rattling which are generated when the rider performs the operation to set the steering angle.

Furthermore, in the steering mechanism of the present invention, it is preferable that the second link section is a column vertically provided on the peripheral surface of the pole section.

According to this configuration, the frictional force between the second link section and a sliding surface can be further decreased.

Furthermore, in the steering mechanism of the present invention, it is preferable that the sliding section is disposed at a position shifted with respect to the second link section in the direction along the rotation axis of the pole section, and the abutment surface is formed in an end surface of the sliding section on a side of the second link section.

According to this configuration, a mechanism which transmits force from the sliding section to the pole section is a simple structure, and hence the mechanism can be decreased in size. Consequently, a part of the steering mechanism can be further easily housed in the vehicle body frame, and hence the aerodynamic performance degradation and aesthetic deterioration due to the steering mechanism can be further easily suppressed.

Additionally, it is preferable that the steering mechanism of the present invention comprises a first regulating section extended from the sliding section in the direction along the rotation axis of the pole section, and a second regulating section disposed at a position which faces the first regulating section in the direction along the rotation axis, the first regulating section faces the second regulating section via a predetermined space in a state where the pole section is at the predetermined rotation angle, and the abutment surface of the sliding section is formed in a shape to move the first regulating section together with the sliding section to a side of the second regulating section, when the pole section is rotated via the second link section.

According to this configuration, when the pole section is rotated to a range more than or equal to a predetermined rotation range, the first regulating section abuts on the second regulating section, to regulate the rotation. This can prevent the pole section from being excessively rotated (i.e., the steering angle of the steering wheel from being excessively increased).

Additionally, in a case where the steering mechanism of the present invention comprises the first regulating section and the second regulating section, it is preferable that the sliding section includes a regulating protrusion which abuts on the second link section to regulate the rotation of the pole section, when the pole section rotates in a state where the first regulating section and the second regulating section abut on the abutment surface.

According to such configuration, the excessive rotation of the pole section is inhibited not only by the first regulating section and the second regulating section but also by the regulating protrusion. Here, since the regulating protrusion is provided on the abutment surface of the sliding section, force applied to the regulating protrusion can be received also by the first link section and the steering wheel which are coupled to the sliding section, via the sliding section on which the abutment surface is formed.

Consequently, even in a case where a large force is applied to the pole section in excess of the predetermined rotation range (e.g., in a state where the first regulating section already abuts on the second regulating section), the rotation can be sufficiently inhibited.

Furthermore, a wheelchair of the present invention comprises a cage where a rider sits down, a vehicle body frame extended in front of the cage, a holding member rotatably attached to the vehicle body frame, and a steering wheel held by the holding member, the holding member including a rod-like pole section rotatably supported by the vehicle body frame to rotate integrally with the steering wheel, characterized by comprising any one of the above steering mechanisms.

Additionally, in the wheelchair of the present invention, it is preferable that the vehicle body frame comprises a cover section which covers at least a part of the pole section, and at least the sliding section and the second link section are housed in the cover section.

Also, in a conventional wheelchair, the cover section which covers at least a part of the pole section is used. Furthermore, in the above steering mechanism, at least the sliding section and the second link section are provided in a surrounding part of the pole section. Consequently, the sliding section and the second link section can be easily housed in the heretofore used cover section. Therefore, according to the wheelchair of the present invention, the steering mechanism of a new design can be incorporated in the wheelchair without changing the conventional design significantly.

Furthermore, in the wheelchair of the present invention, it is preferable that the swing bar is attached at a front end, swingably about a swing axis, to an inside part of the vehicle body frame, and the vehicle body frame is a hollow member inside which the swing bar is swingable.

Among members which form the steering mechanism of the wheelchair of the present invention, the swing bar is a member having a comparatively large size. Therefore, if the swing bar is configured to be housed in the vehicle body frame, the aerodynamic performance degradation and aesthetic deterioration can be efficiently suppressed.

Furthermore, the swing axis of the swing bar is provided at the front end, so that the vehicle body frame which houses the swing bar can be formed in a tapered shape. Consequently, the shape of the vehicle body frame is easily formed in a shape which is advantageous in aerodynamic performance.

DESCRIPTION OF EMBODIMENTS

Hereinafter, description will be made as to a configuration of a wheelchair W according to an embodiment with reference to the drawings. The wheelchair W is for use in a track race, a marathon or the like.

First, a schematic configuration of the wheelchair W will be described with reference to FIG. 1 to FIG. 3.

Figure 1:
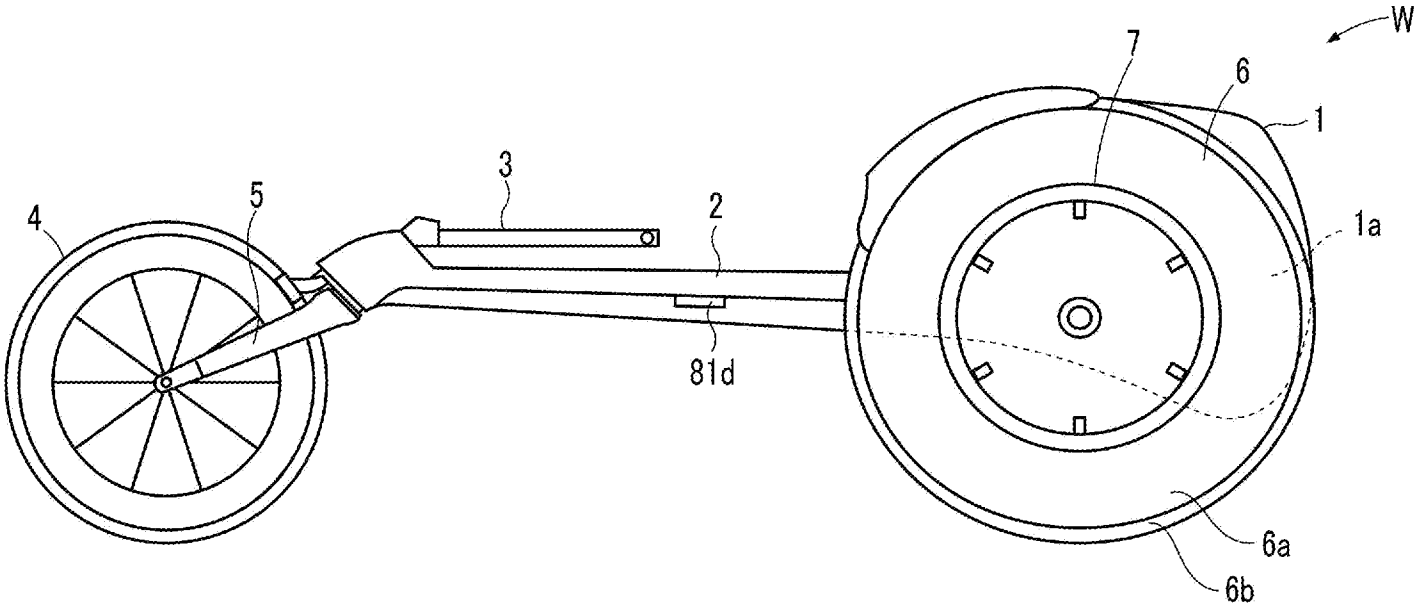
FIG. 1 is a side view of a wheelchair according to an embodiment of the present invention.
Figure 2:
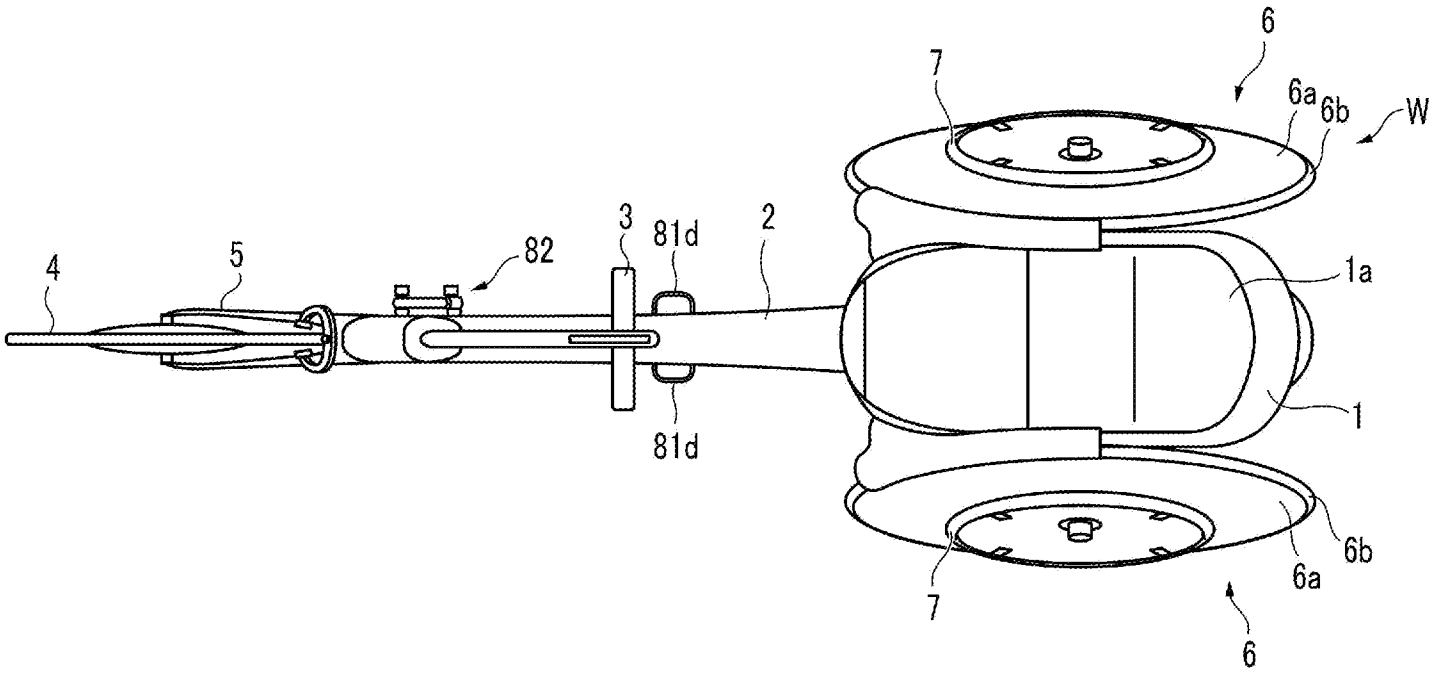
FIG. 2 is a plan view of the wheelchair of FIG. 1.

As shown in FIG. 1 and FIG. 2, the wheelchair W comprises a cage 1, a vehicle body frame 2 extended in front of the cage 1, a steering handle 3 provided in the vehicle body frame 2, a front wheel 4 (a steering wheel) disposed at a front end of the vehicle body frame 2, a front fork 5 (a holding member) attached to the front end of the vehicle body frame 2, and coupled to the handle 3, to hold the front wheel 4, a pair of rear wheels 6 attached to right and left sides of the cage 1, and a hand rim 7 attached to a side of the rear wheels 6 opposite to the cage 1.

As shown in FIG. 2, the cage 1 has an upper part opened, and in the cage, a sitting seat 1*a*, on which an athlete (a rider) sits down, is disposed.

The handle 3 is coupled to a rear end of an after-mentioned column section 5*a* (see FIG. 3) of the front fork 5 pivotally supported by the front end of the vehicle body frame 2.

Each rear wheel 6 is composed of a wheel 6*a*, and a tire 6*b* fitted in the wheel 6*a*. The rear wheel 6 is attached to the cage 1 in a state where the wheel is inclined so that an upper part is closer to a center side of a cage 1 side.

The hand rim 7 is fixed rotatably integrally with the rear wheel 6. The athlete who sits down on the sitting seat 1*a* transmits a driving force to the rear wheel 6 via the hand rim 7.

Figure 3:
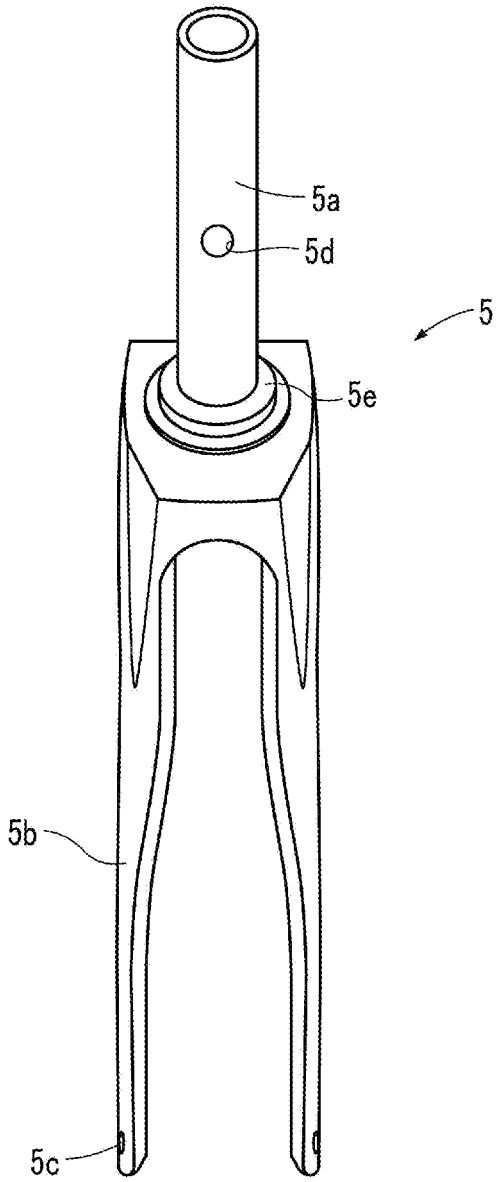
FIG. 3 is a perspective view of a front fork of the wheelchair of FIG. 1 seen from a front surface side.

As shown in FIG. 3, the front fork 5 includes the column section 5*a* (a pole section) supported by the front end of the vehicle body frame 2, and a fork section 5*b* extending forward from the column section 5*a* in a bifurcated state.

A bearing hole 5*c* which supports an axle of the front wheel 4 is formed at a front end of the fork section 5*b*. Furthermore, a first fixing hole 5*d* to fix a cam follower 83*b* of an after-mentioned steering mechanism 8 is formed in an almost center of the column section 5*a*. An annular first bearing 5*e* is fitted in an end of the column section 5*a* on a fork section 5*b* side.

The column section 5*a* is a hollow rod-like (i.e., tubular) member. This member is to acquire strength of the column section 5*a*, and may be a solid rod-like member. The column section 5*a* is rotatably supported at the front end of the vehicle body frame 2 via the annular first bearing 5*e*, at an end on the fork section 5*b* side (a front side). The handle 3 is coupled to the end of the column section 5*a* on a side opposite to the fork section 5*b* (a rear side) (see FIG. 4).

In the wheelchair W comprising such front fork 5, upon rotation of the handle 3, the column section 5*a* coupled to the handle 3, the fork section 5*b* connected to the column section 5*a* and the front wheel 4 held by the fork section 5*b* responsively rotate integrally.

Consequently, in the wheelchair W, the handle 3 is operated to set an orientation of the front wheel 4 (a steering angle of the front wheel 4) via the front fork 5, so that the wheelchair W can turn and run in a desired direction.

Note that a shape of the holding member of the present invention is not limited to such a shape of the front fork 5 as described above, as long as the holding member can hold the steering wheel and includes the pole section rotatably supported by the vehicle body frame. For example, in place of such a fork section as described above, an arm section which is not bifurcated may be employed.

Additionally, in the wheelchair W of the present embodiment, not only the handle 3 but also the steering mechanism 8 are employed as the mechanism to set the steering angle of the front wheel 4. Therefore, next, description will be made in detail as to a structure of the handle 3 and the steering mechanism 8 of the wheelchair W and a surrounding part with reference to FIG. 4 to FIG. 10.

Figure 4:
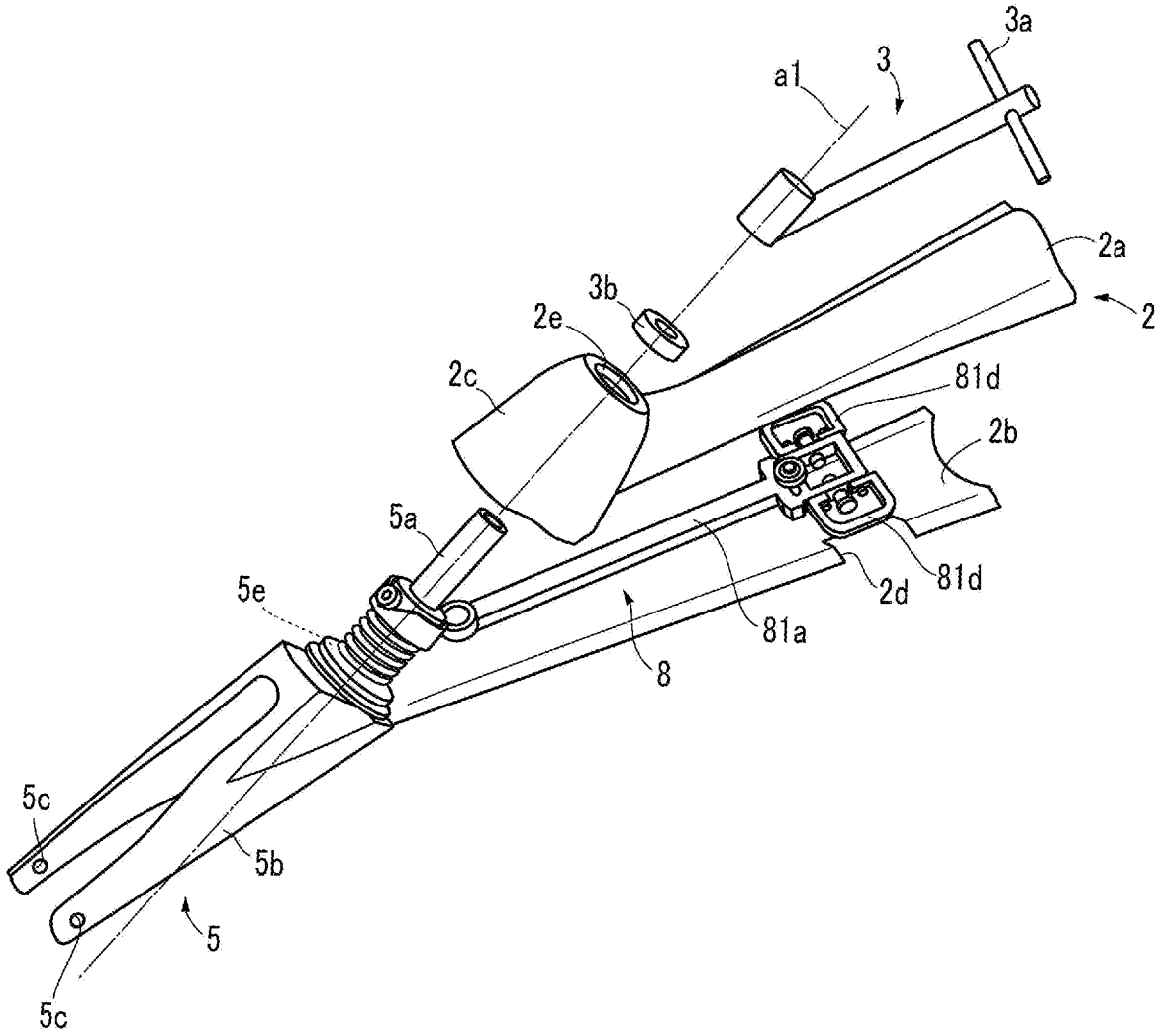
FIG. 4 is an exploded perspective view of a surrounding part of a steering mechanism of the wheelchair of FIG. 1.

As shown in FIG. 4, the vehicle body frame 2 includes an upper surface frame 2*a* and a lower surface frame 2*b* extended forward from the cage 1 (see FIG. 1 and FIG. 2), and a front end frame 2*c* (a cover section) provided at a front end of a tubular portion.

The upper surface frame 2*a* and the lower surface frame 2*b* are connected to each other to form a tubular member. An upper surface side of the tubular member is formed by the upper surface frame 2*a*, and a lower surface side thereof is formed by the lower surface frame 2*b*. In an internal space of the tubular member, an after-mentioned swing bar 81*a* of the steering mechanism 8 is housed swingably right and left about a front end (see FIG. 7).

Furthermore, a pair of first insertion holes 2*d* are formed in opposite side surfaces of the lower surface frame 2*b*. The pair of first insertion holes 2*d* are formed at corresponding positions of a pair of track levers 81*d* provided on opposite side surfaces of a rear end of the after-mentioned swing bar 81*a*, respectively. The first insertion holes 2*d* are sized to such an extent that, when the swing bar 81*a* swings, the track levers 81*d* can be inserted in and removed from the holes.

The front end frame 2*c* is formed by a cup-shaped member with an opening facing downward. A second insertion hole 2*e* is formed at a rear end of the front end frame 2*c* (a bottom of a cup). The front end frame 2*c* is disposed above the fork section 5*b* of the front fork 5, and the column section 5*a* is inserted into the front end frame.

In a state where the front end frame 2*c* is attached to the front fork 5, a part of the steering mechanism 8 is housed in an internal space of the front end frame 2*c*, and a portion of a rear end of the column section 5*a* protrudes from the second insertion hole 2*e* of the front end frame 2*c*.

The handle 3 includes a handle main body 3*a* held to be operated by the rider, and a second bearing 3*b* which rotatably supports the handle main body 3*a* to the front end frame 2*c*.

The handle main body 3*a* is a T-shaped member in plan view. A rear end of the handle main body has a shape which can be held by the rider. On a lower surface side of a front end of the body, a second fixing hole (not shown) is formed. The rear end of the column section 5*a* protruding from the front end frame 2*c* of the vehicle body frame 2 is inserted and fixed to the second fixing hole.

The second bearing 3*b* is an annular member disposed between the handle main body 3*a* and the front end frame 2*c*, and a portion of the column section 5*a* which protrudes from the front end frame 2*c* is inserted into the bearing. The second bearing 3*b* rotatably supports the handle main body 3*a* to an upper surface of a peripheral edge of the second insertion hole 2*e* of the front end frame 2*c*.

In the handle 3 including such a configuration, the handle main body 3*a* is rotatable integrally with the column section 5*a* and the front wheel 4 and about a center axis of the column section 5*a* of the front fork (i.e., a rotation axis a1 of the column section 5*a*).

That is, in the wheelchair W, a rotation angle of the column section is changed not only by operating the after-mentioned steering mechanism 8 but also by rotating the handle main body 3*a*, so that the steering angle of the front wheel 4 can be set.

Figure 5:
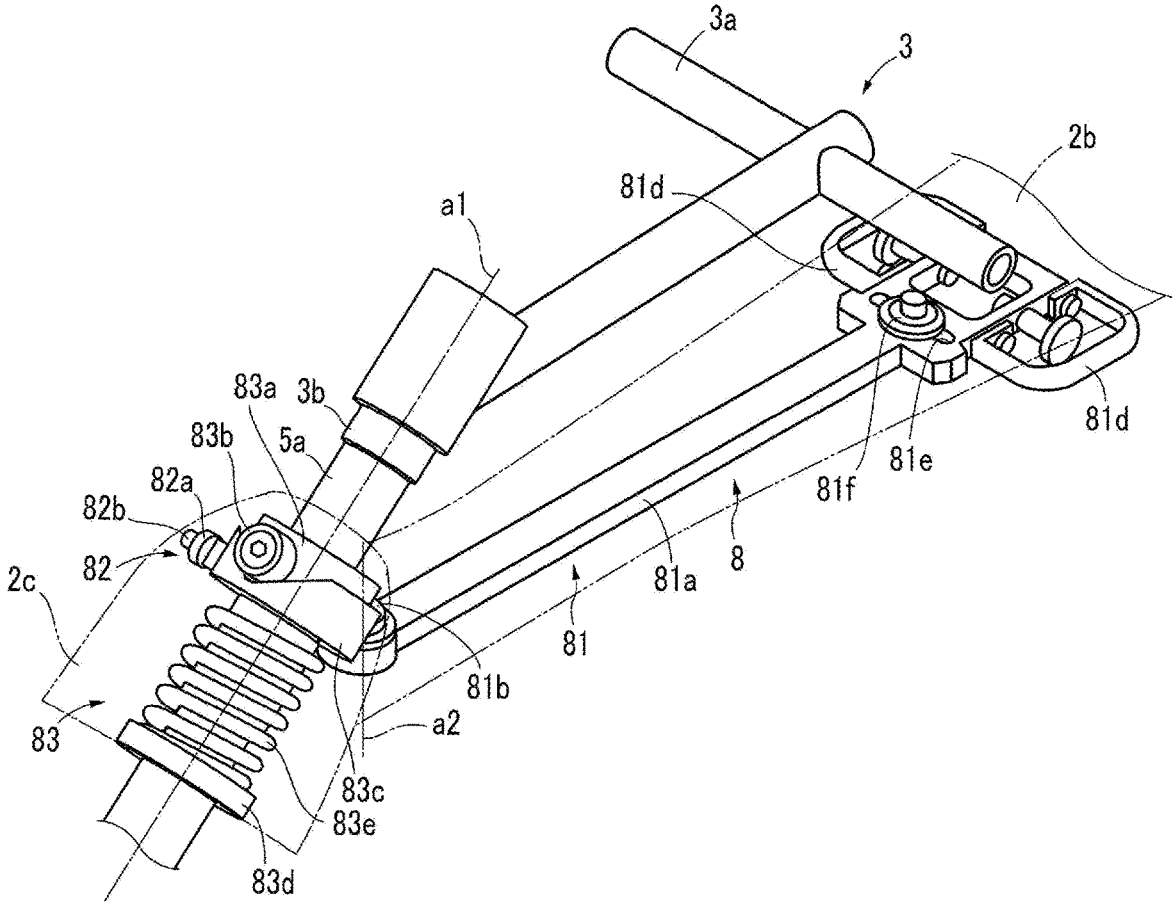
FIG. 5 is a perspective view of the steering mechanism of FIG. 4.
Figure 6A:
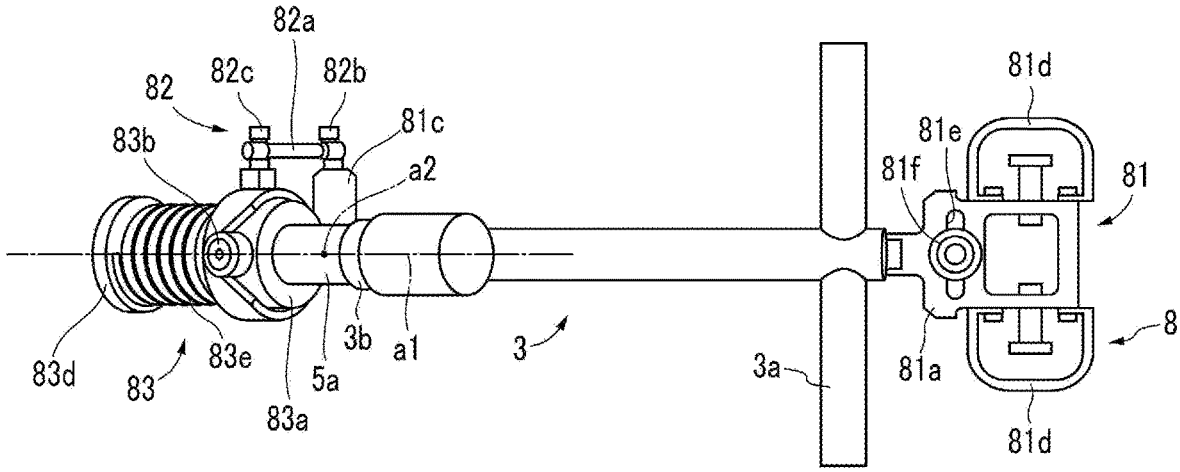
FIG. 6A is a plan view showing a configuration of the steering mechanism of FIG. 4.
Figure 6B:
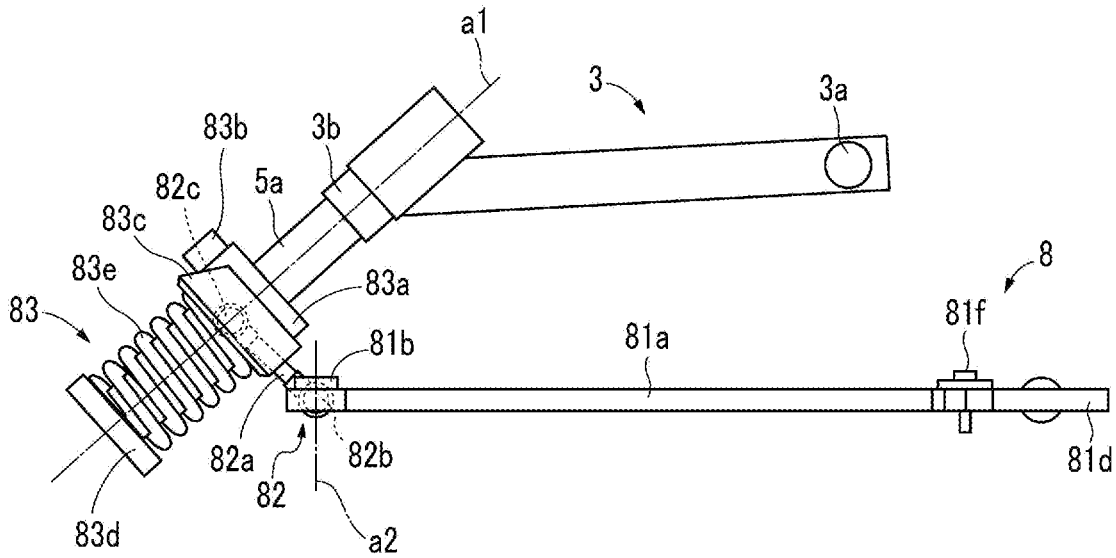
FIG. 6B is a side view showing the configuration of the steering mechanism of FIG. 4.

As shown in a perspective view of FIG. 5 seen from a front side and a plan view of FIG. 6A as well as a side view of FIG. 6B, the steering mechanism 8 comprises an input section 81 into which force to change the steering angle is input by the rider, a transmitting section 82 to transmit the force input into the input section 81, and a rotating section 83 which changes the steering angle of the front wheel 4 with the force transmitted from the transmitting section 82, to change the rotation angle of the column section 5*a*.

The input section 81 includes the swing bar 81*a* extending in a front-rear direction, a first pin 81*b* which fixes a front end of the swing bar 81*a* to the vehicle body frame 2 swingably in a right-left direction, a first coupling protrusion 81*c* vertically provided on a peripheral surface of the front end of the swing bar 81*a*, a pair of track levers 81*d* fixed to both right and left surfaces of a rear end of the swing bar 81*a*, a slide hole 81*e* formed at the rear end of the swing bar 81*a*, and a second pin 81*f* inserted into the slide hole 81*e* and fixed to the vehicle body frame 2.

The rider pushes or taps the track levers 81*d* to swing the swing bar 81*a*, and inputs, into the steering mechanism 8, the force to set the steering angle of the front wheel 4. The force is transmitted to the transmitting section 82 via the first coupling protrusion 81*c* vertically provided on the front end of the swing bar 81*a*.

As shown in FIG. 7, the swing bar 81*a* is swung freely, by the first pin 81*b*, about a swing axis a2 (see FIG. 6B) which coincides with an axis of the first pin 81*b*.

Figure 7A:
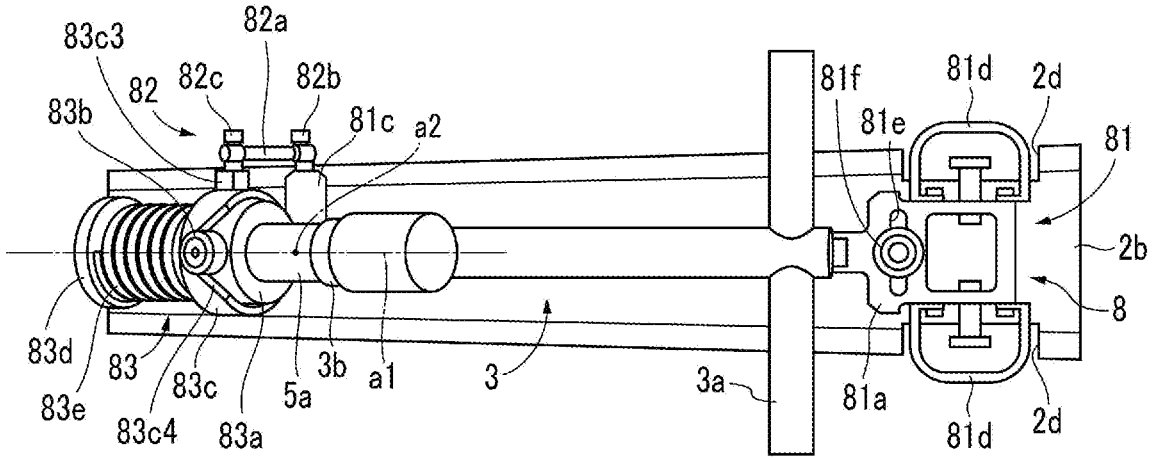
FIG. 7A is a plan view of the steering mechanism of FIG. 4, and shows a state where a column section is not rotated.

As shown in FIG. 7A, in a state where any force to set the steering angle of the front wheel 4 is not input from the rider and the swing bar 81*a* is not swung, the pair of track levers 81*d* slightly protrude from the first insertion holes 2*d* formed in the opposite side surfaces of the vehicle body frame 2, respectively (see FIG. 2).

Figure 7B:
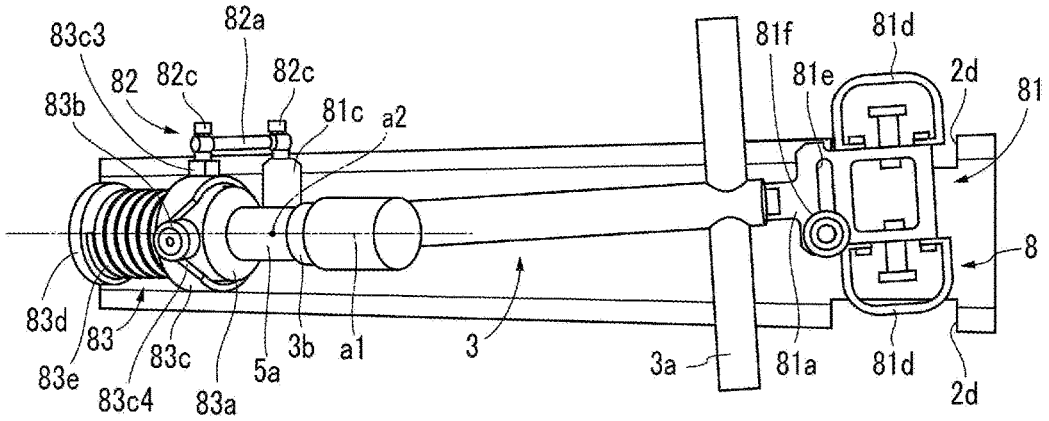
FIG. 7B is a plan view of the steering mechanism of FIG. 4, and is a view showing a state where the column section is rotated via the steering mechanism.

On the other hand, as shown in FIG. 7B, in a state where the force to set the steering angle of the front wheel 4 is input from the rider and the swing bar 81*a* is swung, one of the pair of track levers 81*d* protrudes from the first insertion hole 2*d* formed on one side of the vehicle body frame 2, and the other track lever is housed in the vehicle body frame 2.

The slide hole 81*e* is an oblong hole extending through the rear end of the swing bar 81*a* in an up-down direction, and is formed to be slightly wider than a diameter of a shaft portion of the second pin 81*f*. A peripheral edge of the slide hole 81*e* is pressed by a first head portion of the second pin 81*f* inserted into the slide hole 81*e*.

Therefore, the peripheral edge of the slide hole 81*e* is held between the first head portion and the vehicle body frame 2 to which the second pin 81*f* is fixed. Consequently, a swing position of the swing bar 81*a* is maintained with a pressing force from the second pin 81*f* and the vehicle body frame 2 to the swing bar 81*a*.

That is, in a case where the steering angle of the front wheel 4 is set via the swing bar 81*a*, the steering angle can be fixed to a predetermined angle. Specifically, for example, in a case where the wheelchair W is for use in a track race, the steering angle can be fixed to an angle of a corner of a track.

Furthermore, in either a state where the column section 5*a* is not rotated or a state where the column section 5*a* is rotated, the swing bar 81*a* is housed in the vehicle body frame 2 (specifically, the tubular member formed by the upper surface frame 2*a* and the lower surface frame 2*b*).

Here, the swing bar 81*a* swings right and left about the axis of the first pin 81*b* provided at the front end (the swing axis a2). Consequently, in the wheelchair W, a tapered member may be employed as the tubular member of the vehicle body frame 2 which houses the swing bar 81*a*. Therefore, the vehicle body frame 2 has an advantageous shape in aerodynamic performance.

Note that a swing direction of the swing bar in the present invention is not limited to the right-left direction, and may be appropriately designed in accordance with a configuration of the wheelchair. The direction may be, for example, an up-down direction or a front-rear direction.

Furthermore, in the present invention, a mechanism which inputs the force to set the steering angle of the steering wheel into the swing bar is not limited to such a mechanism of the track levers 81*d* as described above. For example, in a case of a configuration where the swing bar swings right and left, a link mechanism which is driven by sliding a protrusion may be provided in a vicinity of the rear end of the swing bar, and such force may be input into the swing bar via the link mechanism.

Additionally, the vehicle body frame of the present invention is not limited to such a tapered shape as described above, and may be appropriately designed in accordance with the aerodynamic performance and design properties of the whole wheelchair, and additionally the structure and a shape of the steering mechanism.

The transmitting section 82 includes a rod-like ball joint 82*a* (a first link member), a third pin 82*b* to rotatably fix a rear end of the ball joint 82*a* to the first coupling protrusion 81*c* vertically provided at the front end of the swing bar 81*a*, and a fourth pin 82*c* to rotatably fix a front end of the ball joint 82*a* to a second coupling protrusion 83*c*3 of an after-mentioned cam guide 83*c* of the rotating section 83.

The force to set the steering angle of the front wheel 4 that is input by pressing the track lever 81*d* of the input section 81 by the rider is transmitted to the transmitting section 82 via the swing bar 81*a* and the first coupling protrusion 81*c* of the input section 81. Afterward, the force is transmitted to the cam guide 83*c* of the rotating section 83 via the transmitting section 82.

Figure 8:
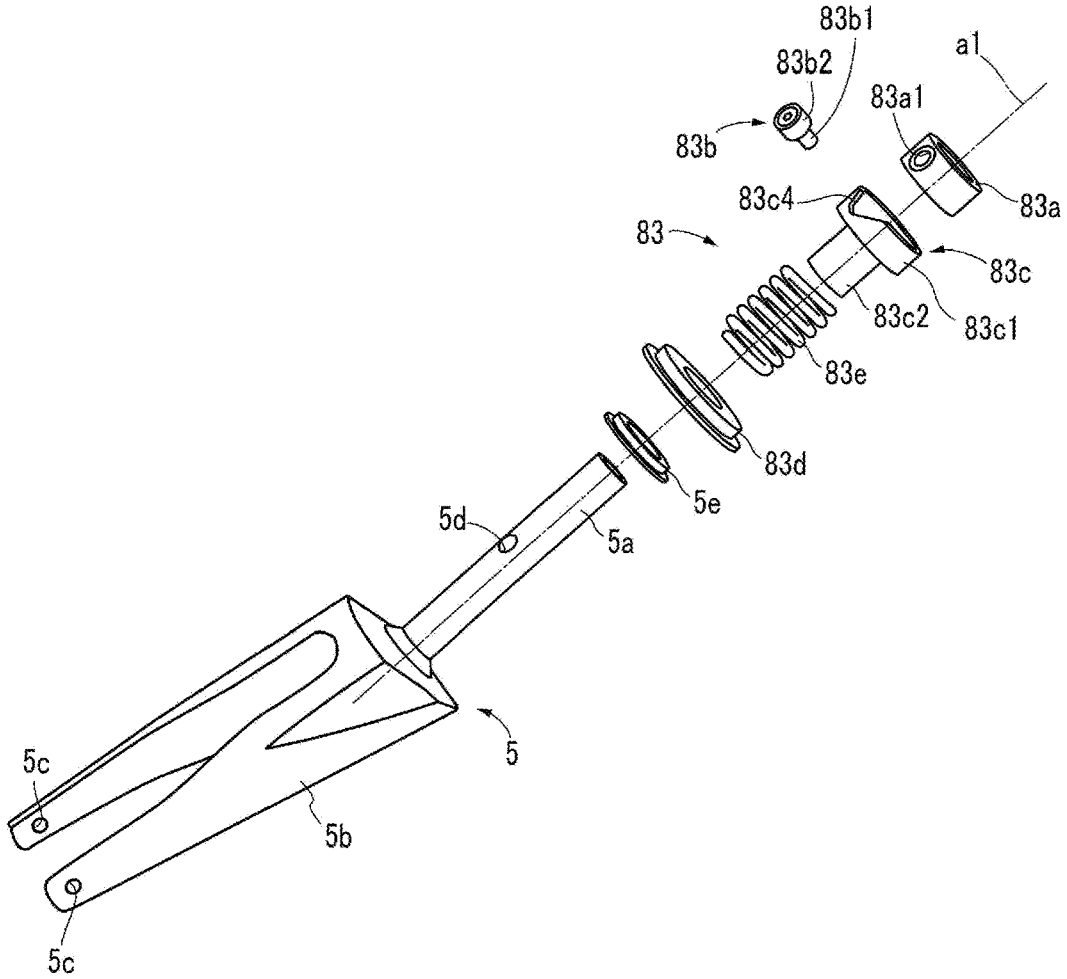
FIG. 8 is an exploded perspective view showing a structure of a surrounding part of the column section of the steering mechanism of FIG. 4.

As shown in FIG. 8, the rotating section 83 comprises a tubular cam spacer 83*a*, a cam follower 83*b* (a second link section) fixed to the first fixing hole 5*d* of the column section 5*a* via the cam spacer 83*a*, the tubular cam guide 83*c* disposed below the cam spacer 83*a* in a direction along the rotation axis a1 of the column section 5*a*, an annular adapter 83*d* (a second regulating section) which is disposed below the cam guide 83*c* in the direction along the rotation axis a1, and into which the column section 5*a* is inserted, and a coil spring 83*e* (an urging section) disposed between the cam guide 83*c* and the adapter 83*d*.

The cam spacer 83*a* is a tubular member into which the column section 5*a* of the front fork 5 is inserted. The cam spacer 83*a* is formed with a third insertion hole 83*a*1 formed to extend through the cam spacer 83*a* in a radial direction.

The cam follower 83*b* includes a shaft portion 83*b*1 vertically provided on a peripheral surface of the column section 5*a* of the front fork 5, and a second head portion 83*b*2 attached to the shaft portion 83*b*1 on a side opposite to the column section 5*a*. A shape of the second head portion 83*b*2 is a columnar shape having the same axis as in the shaft portion 83*b*1. The second head portion 83*b*2 is rotatable about the axis of the shaft portion 83*b*1 to the shaft portion 83*b*1.

Note that the second link section of the present invention is not limited to such a shape, as long as the second link section is vertically provided to protrude toward a peripheral surface of the pole section. For example, as the cam follower, a simply columnar member which does not include any rotating portion may be employed. Furthermore, as the second link section, not a columnar member but also a pillar-like member having a polygonal cross-sectional shape may be used. Alternatively, a protrusion which gently protrudes from the peripheral surface of the pole section may be used as the second link section.

The shaft portion 83*b*1 of the cam follower 83*b* is inserted into the third insertion hole 83*a*1 of the cam spacer 83*a*. In a state of being inserted into the third insertion hole 83*a*1, a tip of the shaft portion 83*b*1 is inserted in and fixed to the first fixing hole 5*d* of the column section 5*a* of the front fork 5.

Consequently, when the column section 5*a* is rotated, an inner peripheral surface of the third insertion hole 83*a*1 is pressed by the shaft portion 83*b*1, and the cam spacer 83*a*, the cam follower 83*b* and the column section 5*a* rotate integrally about the rotation axis a1 (see FIG. 9).

The cam guide 83*c* is a tubular member into which the column section 5*a* of the front fork 5 is inserted, and which can house a lower portion of the cam spacer 83*a*. The cam guide 83*c* is slidable in the direction along the rotation axis a1 of the column section 5*a* and a peripheral direction of the column section 5*a* on the peripheral surface (an outer peripheral surface) of the column section 5*a*.

The cam guide 83*c* includes a tubular large diameter section 83*c*1 (a sliding section) located below the cam follower 83*b* in the direction along the rotation axis a1 of the column section 5*a* of the front fork 5, a tubular small diameter section 83*c*2 (a first regulating section) extended downward from the large diameter section 83*c*1 in the direction along the rotation axis a1, and a second coupling protrusion 83*c*3 (not shown in FIG. 8, see FIG. 9) vertically provided on a peripheral surface of the large diameter section 83*c*1.

An inner diameter of the large diameter section 83*c*1 is slightly larger than an outer diameter of the cam spacer 83*a*. Consequently, the large diameter section 83*c*1 is slidable in the peripheral direction and the direction along the rotation axis a1 on the peripheral surface of the column section 5*a* (strictly, on a peripheral surface of the cam spacer 83*a* fitted in the column section 5*a*).

The large diameter section 83*c*1 includes, on an end surface on a cam follower 83*b* side, a cam surface 83*c*4 (an abutment surface) having a recess surface shape dented in the direction along the rotation axis a1. The cam surface 83*c*4 abuts on a peripheral surface of the second head portion 83*b*2 of the cam follower 83*b*. Furthermore, the large diameter section 83*c*1 includes a pair of regulating protrusions 83*c*5 which protrude slightly upward from opposite ends of the cam surface 83*c*4 in the direction along the rotation axis a1 (not shown in FIG. 8, see FIG. 9).

Note that a position where the abutment surface of the present invention is formed is not limited to the end surface of the sliding section, as long as the abutment surface can abut on the second link section. For example, a through hole extending through an inner peripheral surface and an outer peripheral surface of the sliding section may be formed, and the inner peripheral surface of the through hole may serve as the abutment surface.

An inner diameter of the small diameter section 83*c*2 is slightly larger than an outer diameter of the column section 5*a*, and is smaller than the outer diameter of the cam spacer 83*a*. Consequently, the small diameter section 83*c*2 is slidable in the peripheral direction on the peripheral surface of the column section 5*a*, in a region below the cam spacer 83*a* along the rotation axis a1. Furthermore, an outer diameter of the small diameter section 83*c*2 is smaller than an outer diameter of the large diameter section 83*c*1, and is sized to such an extent that the coil spring 83*e* can be fitted around the small diameter section.

Furthermore, a length of the small diameter section 83*c*2 in the direction along the rotation axis a1 is shorter than a distance between a lower end of the cam spacer 83*a* and an upper end of the adapter 83*d*. Therefore, the small diameter section 83*c*2 is slidable in the direction along the rotation axis a1 on the peripheral surface of the column section 5*a* between the ends.

As shown in FIG. 9, the ball joint 82*a* of the transmitting section 82 is rotatably fixed to the second coupling protrusion 83*c*3 with the fourth pin 82*c*. Consequently, when force to swing the swing bar 81*a* is input into the swing bar 81*a* of the input section 81, the force is transmitted to the cam guide 83*c* via the second coupling protrusion 83*c*3 to which the ball joint 82*a* is coupled, to slide the cam guide 83*c* in the peripheral direction on the peripheral surface of the column section 5*a* (see FIG. 7).

Turning back to FIG. 8, the adapter 83*d* is an annular member into which the column section 5*a* of the front fork 5 is inserted. Furthermore, the adapter 83*d* is a cover-like member including a dent on a lower surface side (see FIG. 10), and covers the first bearing 5*e* located below the adapter 83*d* so as to house the bearing in the dent.

Furthermore, the adapter 83*d* faces a lower end of the small diameter section 83*c*2 of the cam guide 83*c* in the direction along the rotation axis a1 of the column section 5*a* of the front fork 5. An outer diameter of the adapter 83*d* is sized to such an extent that the adapter is fitted in an opening formed on a lower side of the front end frame 2*c* of the vehicle body frame 2.

The column section 5*a* and the small diameter section 83*c*2 of the cam guide 83*c* are inserted into the coil spring 83*e*. An upper end of the coil spring 83*e* abuts on a lower surface of the large diameter section 83*c*1 of the cam guide 83*c*. On the other hand, a lower end of the coil spring 83*e* abuts on the adapter 83*d*.

Here, movement of the adapter 83*d* in the direction along the rotation axis a1 of the column section 5*a* of the front fork 5 is regulated by an upper end surface of the fork section 5*b* of the front fork 5 (see FIG. 10). Consequently, the coil spring 83*e* urges the cam guide 83*c* toward upside (i.e., the cam follower 83*b* side) in the direction along the rotation axis a1.

Next, description will be made as to operations of the handle 3, the front fork 5, and the steering mechanism 8 in the wheelchair W in a case of setting the steering angle of the front wheel 4, with reference to FIG. 5 to FIG. 7, FIG. 9 and FIG. 10.

First, description will be made as to an operation in a case of operating the handle 3 to set the steering angle of the front wheel 4.

As shown in FIG. 5, the handle 3 is fixed to the rear end of the column section 5*a* of the front fork 5. Consequently, when the rider holds the handle 3 to rotate the handle 3 about the rotation axis a1 of the column section 5*a*, the column section 5*a* rotates together with the handle 3, and the steering angle of the front wheel 4 held by the fork section 5*b* of the front fork 5 is set.

Figure 9A:
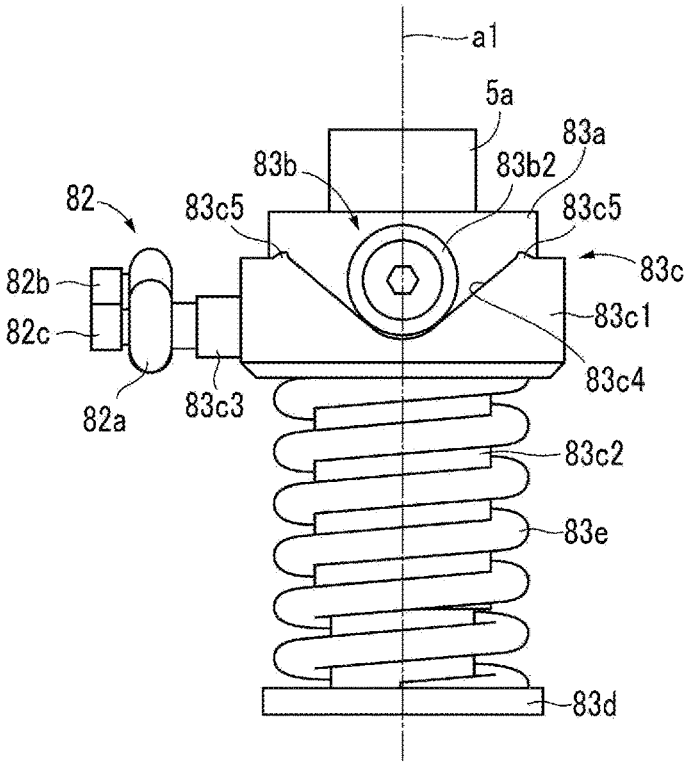
FIG. 9A is a front view showing a configuration of the surrounding part of the column section of the steering mechanism of FIG. 4, and is a view showing a state where the column section is not rotated.
Figure 9B:
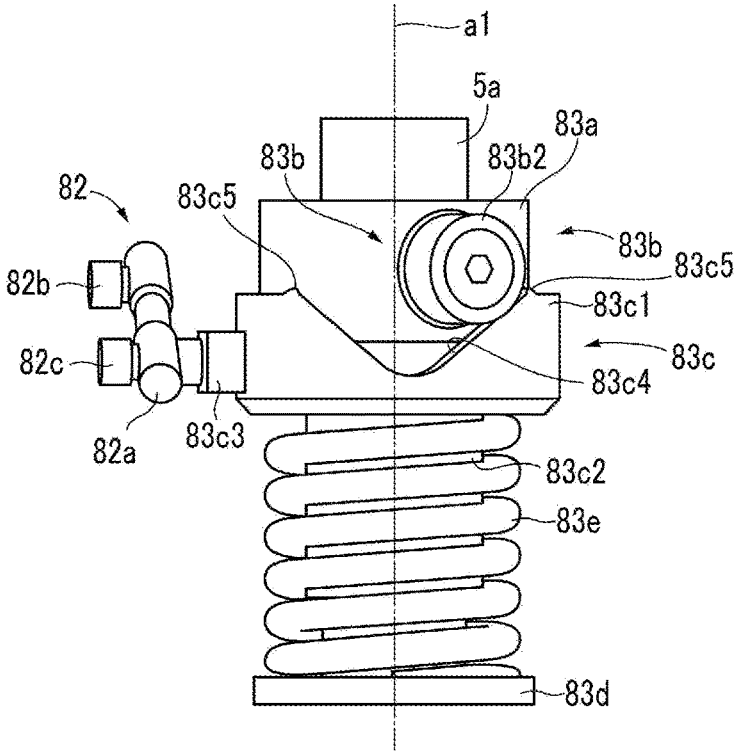
FIG. 9B is a front view showing the configuration of the surrounding part of the column section of the steering mechanism of FIG. 4, and is a view showing a state where the column section is operated and rotated via a handle.

At this time, as shown in FIG. 9, the cam follower 83*b* fixed to the column section 5*a* presses the cam surface 83*c*4 of the cam guide 83*c* while moving in the peripheral direction of the column section 5*a* (e.g., while moving from a position shown in FIG. 9A to a position shown in FIG. 9B).

Here, the cam surface 83*c*4 has the recess surface shape dented downward in the direction along the rotation axis a1, and hence the cam guide 83*c* not only slides in the peripheral direction but also slides downward in the direction along the rotation axis a1.

Therefore, a part of force to slide the cam guide 83*c* is transmitted to the swing bar 81*a* as force in a direction to slide the swing bar 81*a*, via the ball joint 82*a* connected to the cam guide 83*c* (see FIG. 6). However, the force is received by the second pin 81*f* and the vehicle body frame 2 between which the swing bar 81*a* is held, and hence the swing bar 81*a* does not swing.

Additionally, a rotation range of the handle 3 is regulated by the small diameter section 83*c*2 and the regulating protrusions 83*c*5 of the cam guide 83*c*, as well as the adapter 83*d*.

Figure 10A:
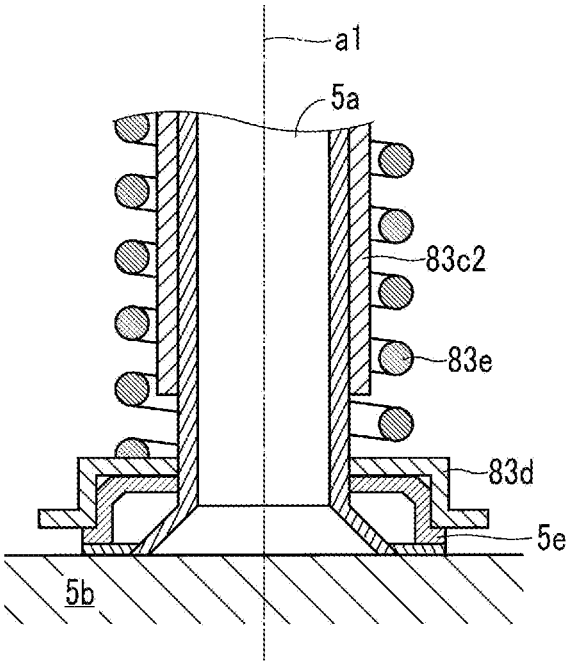
FIG. 10A is a cross-sectional view showing a configuration of a surrounding part of the column section of the steering mechanism of FIG. 4 on a fork section side and is a view showing a state where the column section is not rotated.
Figure 10B:
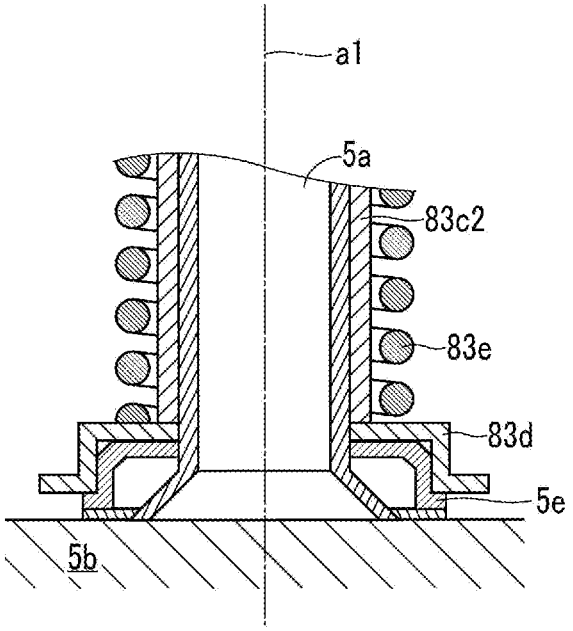
FIG. 10B is a cross-sectional view showing the configuration of the surrounding part of the column section of the steering mechanism of FIG. 4 on the fork section side, and is a view showing a state where the column section is rotated.

Specifically, as shown in FIG. 10, the small diameter section 83*c*2 and the adapter 83*d* are arranged opposite to each other on the rotation axis a1. Then, when the column section 5*a* is rotated via the handle 3, the cam follower 83*b* fixed to the column section 5*a* moves the cam guide 83*c* including the small diameter section 83*c*2 downward (i.e., from a position of FIG. 10A to a position of FIG. 10B) in the direction along the rotation axis a1.

Consequently, if the rider is to rotate the column section 5*a* via the handle 3 in a range more than or equal to a predetermined rotation range, the lower end of the small diameter section 83*c*2 abuts on an upper surface of the adapter 83*d*.

As a result, the rotation of the column section 5*a* to which the cam follower 83*b* is fixed and the handle 3 coupled to the column section 5*a* is regulated via the cam surface 83*c*4 of the cam guide 83*c* including the small diameter section 83*c*2 and the cam follower 83*b* which abuts on the cam surface 83*c*4.

Turning back to FIG. 9, if the handle 3 is to be further rotated in a state where the small diameter section 83*c*2 abuts on the adapter 83*d* (a state of FIG. 9B), there is concern that the cam follower 83*b* falls out of a range where the cam follower can abut on the cam surface 83*c*4.

However, the opposite ends of the cam surface 83*c*4 are provided with the pair of regulating protrusions 83*c*5 over which the cam follower 83*b* cannot ride. Therefore, excessive rotation of the handle 3 to such an extent the cam follower 83*b* falls out is regulated by the regulating protrusions 83*c*5.

Additionally, since the regulating protrusions 83*c*5 are provided on the cam surface 83*c*4 of the cam guide 83*c*, force applied to the regulating protrusions 83*c*5 is also received by the ball joint 82*a* and the swing bar 81*a* coupled to the cam guide 83*c*, via the cam guide 83*c* formed with the cam surface 83*c*4. Consequently, even if a very large force is applied to the handle 3, the force is sufficiently received.

A height of each of the regulating protrusions 83*c*5 may be appropriately set in accordance with the rotation range to be regulated, or the like. For example, in a case where the cam follower 83*b* rotates about an axis of the shaft portion 83*b*1 (see FIG. 8) as in the present embodiment, the regulating protrusion may be provided at a position which is higher than a position of the axis.

After the column section 5*a* is rotated via the handle 3, the rider releases the handle 3, to reach a state where force to maintain a rotating state of the handle 3 is not input. In this state, the handle 3 automatically returns to a predetermined rotation angle determined in advance.

Specifically, the cam guide 83*c* is urged toward the upside (i.e., the cam follower 83*b* side) in the direction along the rotation axis a1, by the coil spring 83*e*. Consequently, in the state where any force is not input via the handle 3, an urging force of the coil spring 83*e* causes the cam guide 83*c* to press the cam follower 83*b* via the cam surface 83*c*4.

Thus, the cam follower 83*b*, the column section 5*a* to which the cam follower 83*b* is fixed and the handle 3 coupled to the column section 5*a* are pressed by the cam guide 83*c*, to automatically return to the predetermined rotation angle determined in advance. Furthermore, at this time, the cam guide 83*c* also slides to return to a predetermined position, due to a reaction force received by the cam follower 83*b* via the cam surface 83*c*4.

Note that the sliding section of the present invention is not limited to the sliding section including the first regulating section and the second regulating section, such as the small diameter section 83*c*2 and the adapter 83*d* of the present embodiment, as well as the regulating protrusion 83*c*5. For example, in a case where a mechanism which inhibits the excessive rotation of the handle is separately provided, the first regulating section and the second regulating section as well as the regulating protrusion may be omitted, and the first regulating section and the second regulating section may only be provided.

Furthermore, the steering mechanism of the present invention is not limited to a steering mechanism including an urging section such as the coil spring 83*e* of the present embodiment. For example, in place of the coil spring, an elastic body such as a rubber may form a mechanism that automatically returns the rotation angle of the pole section. Alternatively, to decrease a weight, the mechanism that returns the rotation angle itself may be omitted.

Next, description will be made as to an operation in a case of operating the steering mechanism 8 to set the steering angle of the front wheel 4.

As shown in FIG. 7, in the case of setting the steering angle of the front wheel 4 via the steering mechanism 8, the rider presses or taps the track levers 81*d*, to input force for the setting.

Thus, upon the input of the force for the setting, the swing bar 81*a* swings in the right-left direction about the axis (the swing axis a2) of the first pin 81*b* located at the front end of the swing bar 81*a* (see FIG. 5 and FIG. 6B) against a pressing force of the second pin 81*f* and the vehicle body frame 2 between which the swing bar 81*a* is held.

When the swing bar 81*a* swings in this way, the force for the setting is transmitted to the second coupling protrusion 83*c*3 of the cam guide 83*c* (and consequently the whole cam guide 83*c*) via the first coupling protrusion 81*c* of the swing bar 81*a* and the ball joint 82*a* which is attached to the first coupling protrusion 81*c*.

The cam guide 83*c* slides in the peripheral direction on the peripheral surface of the column section 5*a* of the front fork 5 due to the force transmitted from the ball joint 82*a*. At this time, a pressing force in the peripheral direction on the peripheral surface of the column section 5*a* is applied from the cam surface 83*c*4 formed on the large diameter section 83*c*1 of the cam guide 83*c* to the cam follower 83*b*.

Consequently, the column section 5*a* to which the cam follower 83*b* is fixed rotates together with the cam follower 83*b* about the rotation axis a1 (turns from a state of FIG. 7A to a state of FIG. 7B). As a result, the steering angle of the front wheel 4 held by the fork section 5*b* of the front fork 5 is set. Note that at this time, the handle 3 rotates integrally with the column section 5*a* in response to the rotation of the column section 5*a* (rotates from a position of FIG. 7A to a position of FIG. 7B).

At this time, the reaction force is applied from the cam follower 83*b* to the cam surface 83*c*4 of the cam guide 83*c*. The cam surface 83*c*4 has the recess surface shape dented in the direction along the rotation axis a1, and hence the cam guide 83*c* slides toward downside (a left side in FIG. 7A) in the direction along the rotation axis a1 against the urging force of the coil spring 83*e*.

In other words, force to return to a non-rotating state (a state of being located in a predetermined rotated position) is applied to the cam guide 83*c* via the cam surface 83*c*4 due to the urging force of the coil spring 83*e*, in the peripheral direction and the direction along the rotation axis a1. In the present embodiment, force to return to a state of being located at the position of FIG. 7A is applied.

Here, the swing bar 81*a* is held between the second pin 81*f* and the vehicle body frame 2. Therefore, the swing position of the swing bar 81*a* is maintained with the pressing force between the swing bar 81*a* and the second pin 81*f* and vehicle body frame 2, as long as the rider does not directly operate the track levers 81*d*.

Therefore, in a case where the steering angle of the front wheel 4 is set via the steering mechanism 8, the swing position of the swing bar 81*a* is maintained, and the rotated position of the cam guide 83*c* coupled to the swing bar 81*a* via the ball joint 82*a* (and consequently the setting of the steering angle of the front wheel 4) is also maintained against the urging force of the coil spring 83*e*.

Consequently, in the case where the steering angle of the front wheel 4 is set via the steering mechanism 8, the steering angle can be fixed to the predetermined angle. Specifically, for example, in the case where the wheelchair W is for use in a track race, the steering angle can be fixed to the angle of the corner of the track.

As described above, in the steering mechanism 8, in the case of setting the steering angle of the front wheel 4 via the steering mechanism 8, first, the force input by the rider is transmitted to the large diameter section 83*c*1 of the cam guide 83*c* (and consequently the whole cam guide 83*c*) via the swing bar 81*a* and the ball joint 82*a*.

Afterward, the cam guide 83*c* causes the cam follower 83*b* to rotate the column section 5*a* to which the cam follower 83*b* is fixed, to set the rotation angle of the column section 5*a* (i.e., the steering angle of the front wheel 4).

Here, the cam follower 83*b* is fixed to the peripheral surface of the column section 5*a*. Furthermore, the cam guide 83*c* including the large diameter section 83*c*1 is configured to slide on the peripheral surface of the column section 5*a*. That is, in the steering mechanism 8, a part of the mechanism to set the steering angle of the front wheel 4 is located in a vicinity of the peripheral surface of the column section 5*a*, or configured to operate in the vicinity of the peripheral surface.

Consequently, in this steering mechanism 8, a part of the mechanism to set the steering angle of the steering wheel 4 is easy to house in a part of the vehicle body frame 2 which is also used in a conventional wheelchair (specifically, the front end frame 2*c* provided at the front end of the vehicle body frame 2 to cover a portion of the column section 5*a* on the fork section 5*b* side).

Therefore, in the steering mechanism 8 of the present embodiment, as compared with the conventional steering mechanism, a part of the mechanism can be easily housed in the vehicle body frame 2. Consequently, when the mechanism is mounted in the wheelchair W, aerodynamic performance degradation and aesthetic deterioration due to the steering mechanism 8 can be suppressed.

Additionally, in the steering mechanism 8, the force to return to the non-rotating state (the state of being located at the predetermined rotated position) is applied to the cam guide 83*c* via the cam surface 83*c*4 due to the urging force of the coil spring 83*e*, in the peripheral direction and the direction along the rotation axis a1.

The force causes the cam surface 83*c*4 of the cam guide 83*c* to press the cam follower 83*b*, and the rotation angle of the cam follower 83*b* and the column section 5*a* to which the cam follower 83*b* is fixed reaches the predetermined rotation angle.

At this time, a frictional force corresponding to the urging force of the coil spring 83*e* is generated in an abutment portion between the cam surface 83*c*4 and the cam follower 83*b*. Therefore, depending on a size of the urging force of the coil spring 83*e*, there is concern that smooth movement is hindered by resistance, rattling or the like caused by the frictional force, in a case where the cam guide 83*c* is moved so that a position of the cam guide 83*c* changes from the predetermined rotated position to another position.

To solve the problem, as shown in FIG. 9A, in the steering mechanism 8, the cam surface 83*c*4 is formed in the recess surface shape dented downward in the direction along the rotation axis a1 of the column section 5*a* of the front fork 5, and is configured so that the cam follower 83*b* is located at the bottom of the cam surface 83*c*4 in a state where the column section 5*a* is at the predetermined rotation angle.

Furthermore, the steering mechanism 8 is configured so that the cam follower 83*b* comes in linear contact with the cam surface 83*c*4 at two positions on the peripheral surface of the second head portion 83*b*2 of the cam follower 83*b*, when the cam follower 83*b* is located at the bottom of the cam surface 83*c*4. Specifically, the bottom of the cam surface 83*c*4 is formed in an arc shape having a curvature radius larger than a radius of the second head portion 83*b*2 of the cam follower 83*b*.

Consequently, in the steering mechanism 8, the force can be sufficiently transmitted, while inhibiting an excessive frictional force from being generated in the abutment portion between the cam surface 83*c*4 and the cam follower 83*b*.

Note that a shape of the abutment surface in the steering mechanism of the present invention is not limited to such a shape as described above. For example, in place of linear contact, point contact may be made. Alternatively, the point contact may be made at one of two contact positions, and the linear contact may be made at the other position.

Furthermore, for example, in a case where the frictional force between the second link section and the abutment surface is small enough to ignore, the abutment surface may have such a shape that the second link section comes in surface contact with the abutment surface in a state where the second link section is located at the bottom of the abutment surface having the recess surface shape. In such a configuration, the rotation angle in the state where the second link section is located at the bottom of the abutment surface can be stably held.

As above, the shown embodiment has been described, but the present invention is not limited to such an aspect.

For example, in the above embodiment, the cam surface 83*c*4, which is the abutment surface, may be formed in a shape to rotate the column section 5*a*, which is the pole section, via the second head portion 83*b*2, which is the second link section, in response to the sliding, when the ball joint 82*a*, which is the first link section, slides the cam guide 83*c*, which is the sliding section. This simplifies the mechanism which transmits the force from the sliding section to the pole section, to decrease the mechanism in size.

However, the second link section and the sliding section of the present invention are not limited to such a configuration, as long as the sliding section is slidable on the peripheral surface of the pole section and the second link section is provided on the peripheral surface of the pole section and rotates the pole section in response to the sliding of the sliding section.

For example, a cam groove provided in the peripheral surface of the pole section may be formed as the second link section, and a pin slidably fitted in the cam groove may be formed as the sliding section.

Furthermore, in the above embodiment, the ball joint 82*a* is employed as the first link member. However, the first link member of the present invention is not limited to the structure of the ball joint, as long as an after-mentioned sliding section is slid on the peripheral surface of the pole section in response to the swinging of the swing bar.

For example, unlike the large diameter section 83*c*1 of the cam guide 83*c* of the present embodiment, the sliding section does not slide in the peripheral direction and the direction along the rotation axis on the peripheral surface of the pole section, and the sliding section slides only in the direction along the rotation axis a1. In this case, the first link member may slide the sliding section in the direction along the rotation axis of the pole section in response to the swinging of the swing bar.

Additionally, for example, in the above embodiment, a part of the steering mechanism 8 is housed in the front end frame 2*c* which is the cover section. However, the steering mechanism of the present invention is not limited to such a configuration. For example, a part of the steering mechanism may be housed in another cover section formed separately from the heretofore used cover section. Alternatively, the whole steering mechanism may be housed in the cover section.

REFERENCE SIGNS LIST

1 cage
1*a* sitting seat
2 vehicle body frame
2*a* upper surface frame
2*b* lower surface frame
2*c* front end frame (a cover section)
2*d* first insertion hole
2*e* second insertion hole
3 handle
3*a* handle main body
3*b* second bearing
4 front wheel (a steering wheel)
5 front fork (a holding member)
5*a* column section (a pole section)
5*b* fork section
5*c* bearing hole
5*d* first fixing hole
5*e* first bearing
6 rear wheel
6*a* wheel
6*b* tire
7 hand rim
8 steering mechanism
81 input section
81*a* swing bar
81*b* first pin
81*c* first coupling protrusion
81*d* track lever
81*e* slide hole
81*f* second pin
82 transmitting section
82*a* ball joint (a first link section)
82*b* third pin
82*c* fourth pin
83 rotating section
83*a* cam spacer
83*a*1 third insertion hole
83*b* cam follower (a second link section)
83*b*1 shaft portion
83*b*2 second head portion
83*c* cam guide
83*c*1 large diameter section (a sliding section)
83*c*2 small diameter section (a first regulating section)
83*c*3 second coupling protrusion
83*c*4 cam surface (an abutment surface)
83*c*5 regulating protrusion

83*d* adapter (a second regulating section)
83*e* coil spring (an urging section)
W wheelchair
a1 rotation axis
a2 swing axis

The invention claimed is:

1. A steering mechanism of a wheelchair comprising a cage where a rider sits, a vehicle body frame extended in front of the cage, a holding member rotatably attached to the vehicle body frame, and a steering wheel held by the holding member, the holding member having a rod-like pole section rotatably supported by the vehicle body frame to rotate integrally with the steering wheel, the steering mechanism comprising:

a swing bar which swings according to input from the rider, a sliding section having an abutment surface and being slidable at least in a peripheral direction on a peripheral surface of the pole section, a first link section which couples the swing bar and the sliding section to slide the sliding section according to the swinging of the swing bar, a second link section which is vertically provided on the peripheral surface of the pole section to protrude from the peripheral surface, and which abuts on the abutment surface to rotate the pole section according to the sliding of the sliding section, and an urging section which urges the sliding section to rotate and return the pole section to a predetermined rotation angle via the sliding section and the second link section, wherein the abutment surface is a recess surface dented in a direction along a rotation axis of the pole section, the second link section is located at a bottom of the abutment surface in a state where the pole section is at the predetermined rotation angle, and the second link section comes in contact with the abutment surface at two positions on the peripheral surface of the second link section, when the second link section is located at the bottom of the abutment surface.

2. The steering mechanism according to claim 1, wherein the second link section is a column vertically provided on the peripheral surface of the pole section.

3. The steering mechanism according to claim 1, wherein the sliding section is disposed at a position shifted with respect to the second link section in the direction along the rotation axis of the pole section, and the abutment surface is formed in an end surface of the sliding section on the second link section side.

4. The steering mechanism according to claim 1, further comprising:

a first regulating section extended from the sliding section in the direction along the rotation axis of the pole section, and a second regulating section disposed at a position which faces the first regulating section in the direction along the rotation axis, wherein the first regulating section faces the second regulating section via a predetermined space in a state where the pole section is at the predetermined rotation angle, and the abutment surface of the sliding section is formed in a shape to move the first regulating section together with the sliding section to the second regulating section side, when the pole section is rotated via the second link section.

5. The steering mechanism according to claim 4, wherein the sliding section includes a regulating protrusion which abuts on the second link section to regulate the rotation of the pole section, when the pole section rotates in a state where the first regulating section and the second regulating section abut on the abutment surface.

6. A wheelchair comprising:

a cage where a rider sits, a vehicle body frame extended in front of the cage, a holding member rotatably attached to the vehicle body frame, and a steering wheel held by the holding member, the holding member including a rod-like pole section rotatably supported by the vehicle body frame to rotate integrally with the steering wheel, wherein the wheelchair comprises the steering mechanism according to claim 1.

7. The wheelchair according to claim 6, wherein the vehicle body frame comprises a cover section which covers at least a part of the pole section, and at least the sliding section and the second link section are housed in the cover section.

8. The wheelchair according to claim 6, wherein the swing bar is attached at a front end, swingably about a swing axis, to an inside part of the vehicle body frame, and the vehicle body frame is a hollow member inside which the swing bar is swingable.

* * * * *